US008047925B2

(12) United States Patent
Burgaard et al.

(10) Patent No.: US 8,047,925 B2
(45) Date of Patent: Nov. 1, 2011

(54) PLAYGROUND DEVICE WITH MOTION DEPENDENT SOUND FEEDBACK

(75) Inventors: Peder Burgaard, København (DK); Henrik Sommer Poulsen, Århus (DK); Mette Keller Stubkjær, Bryrup (DK); Jonas Gam Nielsen, Århus (DK); Tina Rosholm Olesen, Århus (DK)

(73) Assignee: PLAY IT SOUND ApS, Aarhus N (DK)

( * ) Notice: Subject to any disclaimer, the term of this patent is extended or adjusted under 35 U.S.C. 154(b) by 649 days.

(21) Appl. No.: 11/990,476

(22) PCT Filed: Aug. 16, 2006

(86) PCT No.: PCT/DK2006/000449
§ 371 (c)(1),
(2), (4) Date: Feb. 14, 2008

(87) PCT Pub. No.: WO2007/019861
PCT Pub. Date: Feb. 22, 2007

(65) Prior Publication Data

US 2009/0105001 A1 Apr. 23, 2009

(30) Foreign Application Priority Data

Aug. 16, 2005 (DK) ..... 2005 01158
Sep. 21, 2005 (DK) ..... 2005 01316

(51) Int. Cl.
*A63G 9/00* (2006.01)
*A63H 33/22* (2006.01)

(52) U.S. Cl. ..... 472/118; 446/219

(58) Field of Classification Search ..... 446/219, 446/298, 397, 175, 438; 472/118–125, 59–61, 472/130, 43
See application file for complete search history.

(56) References Cited

U.S. PATENT DOCUMENTS

| | | | | |
|---|---|---|---|---|
| 5,413,298 | A * | 5/1995 | Perreault | 248/228.6 |
| 5,766,084 | A * | 6/1998 | Smith | 472/120 |
| 5,833,545 | A | 11/1998 | Pinch et al. | |
| 5,861,808 | A | 1/1999 | Lehmann | |
| 6,203,395 | B1 | 3/2001 | McElhaney | |
| 6,416,381 | B1 | 7/2002 | Walter | |
| 6,778,866 | B1 | 8/2004 | Bettwy | |
| 2003/0106455 | A1 | 6/2003 | Weston | |

FOREIGN PATENT DOCUMENTS

| | | |
|---|---|---|
| EP | 1130570 | 9/2001 |
| GB | 2325558 | 11/1998 |
| JP | 09/084964 | 3/1997 |
| WO | WO2004/004178 | 1/2004 |

* cited by examiner

*Primary Examiner* — Kien Nguyen
(74) *Attorney, Agent, or Firm* — James Creighton Wray

(57) ABSTRACT

Playground device, for example a swing or a see saw, having a ground supported, movable part and at least one motion sensor configured for sensing the motion of the movable part. The motion sensor is functionally connected to a sound signal feedback generator that is configured for converting the signals from the motion sensor into a sound feedback in response to the motion of the movable part. The sensors are mechanically connected only to the movable part in order to provide system with a large number of variations of embodiments.

20 Claims, 9 Drawing Sheets

PLAYGROUND DEVICE WITH MOTION DEPENDENT SOUND FEEDBACK

Figure 1A:
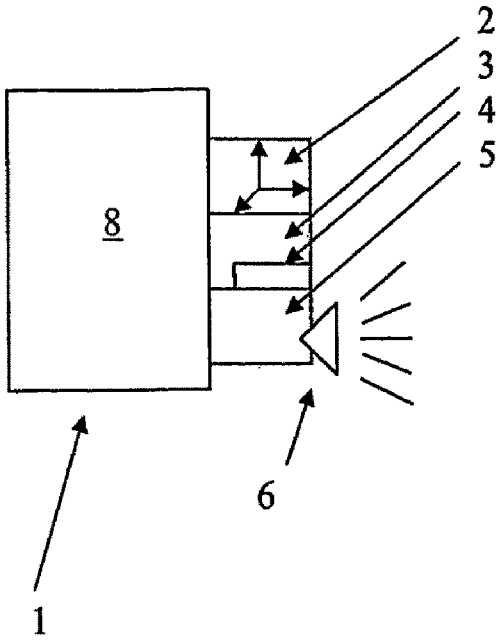

This application claims the benefit of Danish Application No. PA 2005 01158 filed Aug. 16, 2005, Danish Application No. PA 2005 01316 filed Sep. 21, 2005, and PCT/DK2006/000449 filed Aug. 16, 2006, which are hereby incorporated by reference in their entirety.

FIELD OF THE INVENTION

The present invention relates to playground devices, for example a swing or a see-saw, where a sound feedback is given in dependence on the motion of the playground device.

BACKGROUND OF THE INVENTION

Swings, see-saws, ropeways, and suspension bridges are classical devices on children playgrounds. Despite the popularity of electronics in the everyday life of children, such classical playing devices are still an attraction for children. An advantage is it to combine such classical playground equipment with electronic effects to even increase the popularity. Such a combination can have an increased attraction on children that are fascinated in the electronic play world and rather would stay indoor instead of using the body on an outdoor facility.

On the Internet page www.tati.dk/eng/frame/hel.html is disclosed a swing in a room shown at an exhibition in Copenhagen in 2004. The swing—being only in an experimental stage not yet mature for commercialisation—is provided with a bend sensor measuring the bending of the rope holding the seat of the swing, such that the back and forth movement of the swings bend the sensor relatively to the stationary frame, the bending of which is translated by a computer into a sound picture. Though, being a combination of a swing and an electronic sound feedback system, this device has not been matured to be a practical solution suitable for customer's demands on versatile solutions that are easily implemented in a variety of existing devices.

DESCRIPTION/SUMMARY OF THE INVENTION

It is therefore the object of the invention to provide a practical solution that is easily implemented in different, existing, classical playground devices and new forms of playground devices, in a way that these devices can give a sound feedback in dependence on the motions of the devices.

This object is achieved with a playground device having a ground supported, movable part and at least one motion sensor configured for sensing the motion of the movable part. The motion sensor is functionally connected to a sound signal feedback generator that is configured for converting the signals from the motion sensor into a sound feedback in response to the motion of the movable part. In addition, the sensors are mechanically connected only to the movable part, for example by being integrated inside the movable part By connecting the sensors only to the movable part, for example by installing the sensors into the movable part, a much larger variation of embodiments are possible than if the sensors are connected between a stationary support and the movable part, as it, for instance, is the case for the above mentioned swing shown at the exhibition in Copenhagen. For example, the motion sensors may be integrated in not only swings, but also ropeways, see saws, suspension bridges as well as in balance boards and even in garden play devices such as pole tennis. Also, the motion sensors are able to measure independently of any stationary support, making it possible to measure in more than one dimension, preferably measuring in all three dimensions. In contrast thereto, the above mentioned swing only measures motion in one—polar—dimension. In addition, the independence of the motion sensors from any stationary support allows an easy integration of the sensors in an add-on unit, such as a box attachable to the movable part. For example, such a box may be attached to a seat of an existing swing. Alternatively, seat of a swing may be fabricated with the motion sensors inside, such that, after purchase, the user may mount the sensor containing seat on an existing swing instead of the old seat. All these options are not possible, if the sensors are also connected to the stationary part. Thus, by the invention, a device has been provided which due to its large variety of options is far superior to the swing as shown at the Copenhagen exhibition. A swing according to the invention is easily installed by layman in existing environments such as private gardens. This is in contrast to the swing of the exhibition in Copenhagen, which is wired to an external computer not suitable for outdoor conditions. Furthermore, layman is, normally, not able to install bend sensors correctly and connect it to a swing and a computer.

On a playground, a number of devices may be equipped with a sound feedback generator. Persons, primarily children, using such number of devices may face an entirely new world of experiences in the playground, where the movement of the device and sequences of movements leads to a sound feedback as an additional dimension in the play.

For example, in the case of the playground device being a swing, a sound feedback may be given in dependency of the height of the seat of the swing during swinging or a speed dependent sound response. The response may be in the form of sound pattern that are repeated for identical movements. Alternatively, the sound pattern may depend on a sequence of movements. For users, such as children, the device according to the invention opens a new universe of interactive sound governed by movement of the body of the user. This leads to different experiences of classical playground devices. In a certain embodiment, the task for the user of the device may be to move the movable part in time with certain music. The feedback could be either to play the music at a speed determined by the movement or to change the sound level in dependence of the motion of the movable part. In addition, the interactive sound may be changed easily and lead to a new experience for each new use of the same playground device.

The sound feedback signal generator comprises a computer adapted to the actual needs. The computer receives the sensor signals, performs the necessary calculation in dependence on the programming of the computer. The program can be integrated in a computer memory or may be received from the outside through an interface connection with a data storage medium, for example a memory card or a memory stick insertable into the unit that contains the sound feedback signal, generator and, optionally, the sensor or sensors. Alternatively, the interface of the unit may be configured for wireless transmission from an external data storage medium.

For a child, the use of playground devices according to the invention is far more exciting, and, as explained in more detail below, the invention may be used to promote collaboration with other children. In a more advanced embodiment, the characteristic of the movement of the swing may determine the events in a told story. For example, in the case of a swing with a tyre as a standing support or seat for the children, special movements or pattern of movements may have to be performed, such as turning and swinging at the same time, in order for the story to proceed in a certain direction. In such embodiments, the device according to the invention has a teaching effect with a large number of challenges and may promote the social behaviour of children, for example when a number of children are standing on the tyre of the swing at the same time and have to collaborate to perform the demanded movements of the tyre.

In addition, the story may be built up like computer games, where problems have to be solved either by a single child or in collaboration with other children. Therefore, in a further embodiment, the data storage medium comprises a game and wherein the sound feedback signal generator is configured upon reading of the data from the game data storage medium to give a sound feedback in accordance with predetermined game rules, the game rules define which consecutive steps in dependence of certain motion patterns of the movable device, for example measurable in all three dimensions, offers level progression in the game. As the user progress in the game new types of sound are introduced.

For example, each user may insert his own memory stick or card into the single unit in order to play a game. In a further alternative, the interface of the single unit is configured for connection with a mobile device, such as a mobile phone, mp3-player etc. The connection can be achieved by docking the mobile telephone to the single unit, by connecting the mobile telephone to the unit by a cable or by a wireless data connection, for example a Bluetooth or ZigBee connection. Children—or adults—may use the memory stick or card or the telephone to carry their own game around, either an individual game, which correlates the content of the memory stick or the mobile device, or a game in collaboration with other children. The mobile data storage memory could also comprise user data and may help the user to keep its own role in a complex game, where users play with or against each other having different roles in a game, just as it is known from computer role games. This type of game can take place on the same playground device or between different playground devices connecting over short or long distances e.g. with the mobile device, or competition can take place between real life users of the playground devices and virtual avatars, using a virtual replicate of the real playground devices, in virtual worlds like Second Life and Sims Online. Games for a device according to the invention, or example for a single unit as an add-on unit, may be purchased by the user as far as more and more games are developed for devices according to the invention. Also, such games may be used by telephone companies for competitive promotion of their product. Especially for children and teenagers, who are frequently changing their telephone models, games may be an important factor, if devices according to the invention achieve increasing popularity.

Above and in the following, the term motion sensor is used generally and covers also a number of motion sensors. Such motion sensors may be used to measure at least one of the following, position, orientation, velocity, and acceleration. In the case of the swing, the motion sensor can be integrated in the seat or other parts of the swing, for example in the bearings and hinges, though integration into the swing seat is preferred.

The invention covers a large range of devices, for example swings, see-saws, bridges, where the device has a stationary, ground supported frame and the movable part connected to the frame, but also movable balance boards that rest directly on a support. Even for garden plays like pole tennis, the invention may be applied.

In one embodiment, the sensors are electronically connected to a data sending unit configured for wireless transmission of data to the sound signal feedback generator. Correspondingly, the sound signal feedback generator comprises a data receiver for wireless receiving of the transmitted data. For example, the sensors may be integrated in the movable part, and the sensor signals may then be transmitted wireless to the sound feedback generator. In the case of a swing, the sensors may be attached to or integrated in the seat or standing support, whereas the sound signal feedback generator is placed at a different location and receives the signals from the sensors by wireless transmission, for example a radio transmission or Bluetooth transmission. This embodiment is advantageously in the case, where sensors are placed different places on the movable part, for example in order to measure different physical parameters. This embodiment is also advantageously in the case, where sensors are placed on different playground devices, and where the sound feedback signal generator gives a sound feedback dependent on the plurality of the sensors. Such an embodiment may be used to promote the interactive playing of several children on a playground. Instead of children collaborating on a single device, the children may collaborate or even compete on different devices. The embodiment, where the sensors are part of the moving device and the sound feedback signal generator is connected by wireless means may be of advantage in the case of pole tennis, where the sensors are located in or on the ball and the sound feedback generator is placed at a different location.

However, in a preferred embodiment, the sound signal generator and the motion sensor are located in a single unit. Such a unit may be attached or integrated in the moving device, for example the seat or standing support. This embodiment is a more compact solution. The computer of the sound feedback generator can be produced with high computing capacity but with small dimensions, making it suitable to be integrated in a rather small unit. This solution can also be produced at rather low cost and are easy for the user to install.

The sound signal feedback generator generates a sound signal that, typically, has to be amplified in order to give a sound in a loudspeaker. Such an amplifier for the sound may also be integrated in the single unit. In the case, where the loudspeaker has a low power consumption, such as headphones used by the user, the necessary power demands are low and the single unit may be small. This is also the case, if small sound loudspeakers are used, which are integrated in the single unit. In this case, a very compact solution is achieved where the sensors, the feedback generator and the loudspeaker are placed in a single unit, which is easy to attach or integrate in the movable part as an add-on solution. However, in the case, where a large and powerful loudspeaker is desired, for example in competitions, it is advantageous, if the sound signal from the sound feedback signal generator is transmitted to the amplifier for final amplification and feeding into a loudspeaker system. The amplifier may be included in the loudspeaker cabinet. This solution allows the user to customise the system according to the invention in dependence of the actual desires and needs.

In a specific embodiment, the at least one motion sensor is configured to measure independently in at least two dimensions, and the sound signal feedback generator is configured to give a sound signal feedback dependent on, whether the movement is in a first dimension or in a second dimension or in a combination of the first and the second dimension. This is different compared to the mentioned swing from the Copenhagen exhibition which only measures movements in one (polar) dimension.

Alternatively, the at least one motion sensor is configured to measure independently in three dimensions, and the sound signal feedback generator is configured to give a sound signal feedback varying dependent on, whether the movement is in a first dimension, in a second dimension, in a third dimension, or in a combination of the first, the second dimension and the third dimension. Especially in connection with game plays, as described above, such an embodiment is of great advantage, because it allows a great variety of simple as well as complex movements, which is desirable in game, where the user has to improve the skills in order to continue the game.

The motion sensor or sensors may be of the type configured to measure position of the movable part, velocity of the movable part, and/or, preferably, acceleration of the movable part. Especially accelerometers have proven to be of advantage, as these can measure position, speed and acceleration and, thus, only one type of motion sensor is necessary. Furthermore, accelerometers are available at low cost and with relatively high accuracy in addition to being very robust in the sometimes harsh playground environment. However, other types of sensors may be used, for example sensors involving gyroscopes and or tilt sensors, where a liquid level indicates the direction.

In another embodiment, the device also comprises a light sensor for measuring light conditions around the movable part, the light sensor being electronically connected to the sound feedback generator, and wherein the sound feedback generator is configured for giving sound feedback in dependence of the light conditions. Stories told or sound or music played as a sound feedback may include the fact that it is evening or noon in order to expand the universe of experiences by a child.

In order to be user friendly without disturbing the surroundings, in a further embodiment, the device also comprises a sound sensor for measuring the background sound level around the movable part, the sound sensor being electronically connected to the sound feedback generator, and wherein the sound feedback generator is configured for adjusting the feedback sound level in dependence of the background sound level.

In many of the devices according to the invention, the movable part is configured for supporting a person, for example in the form of a seat or in the form of a stand support. For use in the case of a swing or a ropeway and possibly other playground devices, the movable part is a ring for seating or standing on the ring of a person.

The feedback sound pattern in the form of music or sound or a story should be dependent on the age of the child. This may be programmed into the sound feedback generator. However, certain parameters may be used by the sound feedback generator in order to automatically determine the possible age of the user. One of the means for such a determination may be a weight sensor for measuring the weight of a person on the movable part or using certain algorithms to create a level of artificial intelligence capable of analysing user data to create a feedback mechanism based on user interaction which will determine the level of skill of the user. The weight sensor is electronically connected to the sound feedback generator, and the sound feedback generator is configured for giving a sound feedback in dependence of the signal from the weight sensor.

In a further embodiment, the sound feedback may be combined with a vibration or shaking of the movable part, for example a swing seat. Therefore, in a further embodiment, the device also comprises a vibration feedback generator configured to impart vibrations on the movable part in dependence on received data from measurements by the motion sensor. The vibration feedback generator may be applied in addition to the sound signal feedback generator or instead of the sound feedback signal generator. Therefore, in the foregoing and the following, the sound feedback generator may be substituted by a vibration feedback generator.

In the following, a number of examples are given to illustrate the versatility of the invention.

In the case, where the device is a swing, the movable part may comprise or be a seat or a stand support, for example a ring, which may be used for seating as well as for standing, especially if the ring is made in a resilient material, as it is known for classical swings, where the seat or stand support often is a large tyre. The sound feedback generator may be configured in a variety of ways to give feedback, for example, depending on the height of the seat or stand support during swinging, depending on the position or orientation of the seat or stand support during swinging, depending on the distance of the seat or stand support from a reference position or depending on a combination of these parameters.

In addition, the sound signal feedback generator may be configured to give a sound feedback independently for each of two or three dimensions of the motion of the seat. The swing may give a first sound feedback if the motion is in a first direction, for example back and forth, and another feedback if the motion is in another direction, for example from side to side. It should be emphasized here that the term dimension not necessarily refers to Cartesian coordinates but may also refer to polar coordinates. Combinations of the movements in the different dimensions may lead to further sound feedbacks. Thus, one feedback may be given for a motion back and forth, whereas a different feedback may be given for a rotation of the swing, and a further feedback, when the movements are combined or more complex motions are detected by the sensor or sensors.

If the swing is used, the feedback generator may be programmed in a way such that the user is urged to move the movable part in a certain motion pattern. For example, the feedback generator may be configured to receive sensor signals indicating that the user performs at least one of the following,

- moving the seat or ring to certain preprogrammed position in space,
- swinging or rotating the movable part in a certain direction,
- swinging the movable part to a certain height, for example until the movable part is falling freely after a swing of the movable part to the largest possible distance in the horizontal direction,
- jumping on the movable part.

Alternatively, the user may be urged to perform a combination of the swing movements above, for example as required in order to get a told story to continue, or to play a game.

Generally for the devices according to the invention, as well as the swing, the feedback generator may be programmed to require a certain combined pattern of motions as indicated by the sensors in order to proceed with a story telling. The feedback generator may also be programmed to give the feedback in a game story, which appears to the user as playing a game with different performance levels, such that a new performance level is reached with a new part of the story only if the sequence of motion by the user as sensed by the detectors is in accordance with pre-programmed data.

In the case of the device being a see saw, the movable part may be a see-saw beam with a seat on each side of a rotational support of the beam. Alternatively, the movable part may be a cross of beams with a seat on each of the four ends of the crossed beams. Even a different number of beams and seats may be used for such a device. The sound feedback generator may be configured in a variety of ways to give feedback, for example, depending on the up and down rhythm of the seat movement, depending on the height of the seat movement, depending on the rotational or tilt angle of the beam with respect to the stationary ground support, or depending on a combination of these parameters.

In the case of the device being a ropeway, the movable part may be a seat or standing support. For example, the motion sensor or sensors may be located in the seat or standing support slidingly fastened to a rope or wire. The sound feedback generator may be configured in a variety of ways to give feedback, for example, depending on the direction of movement of the seat or standing support. A possibility in this respect is the sound feedback being dependent on, whether the movement is in a first dimension or in a second dimension or in a combination of the first and the second dimension. In certain cases, the seat or standing support may be connected rotationally to the wire for rotation of the seat or standing support in a horizontal plane. In such a case, the device may comprise rotation sensors in the connection between the seat or standing support and the wire, wherein the rotation sensors are electronically connected to the sound feedback sensor configured to give sound feedback dependent on the rotational angle of the seat or standing support or dependent on the change of the rotational angle of the seat or standing support or dependent on both.

In the case of the device being a suspension bridge, the movable part may comprise ropes or wires holding planks for support of a person on the planks. For example, a motion sensor may be positioned in a rope or wire or possibly in a plank. In a further development, the device may also comprise a sensor for measuring the position of a person on the movable part, for example by incorporating sensors in a number of planks. The sound feedback generator may in this case be configured in a variety of ways to give feedback, for example, depending on the position of the person on the movable part, depending on the change of the position of the person on the movable part or both. In addition, the device may also include a vibration feedback generator configured for giving a vibration feedback dependent on the position of the person on the movable part.

In the case of the device being pole tennis, the movable part is a ball hanging in a wire from a standing support. The motion sensor may be integrated in the ball. Alternatively, or in addition, a sensor may be integrated in the pole measuring the rotation of the wire around the pole. Sound feedback is given in analogy to the above mentioned examples. However, it may be of advantage, if the amplifier and the loudspeaker are provided externally, though this is not strictly required.

The invention is also applicable to a balance boards, for example of the type with an elongated board on a cylindrical support or a circular board on a fastened semispherical support. Sensors for orientation to measure the orientation or the change of orientation may be incorporated in the board. The feedback may be in the form of sound alone, but may also be combined with a vibration feedback. A weight sensor may advantageously be applied for an indication of the age of the child using the board.

In a device according to the invention, the motion sensor may be integrated in the movable part, but other alternatives are possible, as also indicated above. The sensors are functionally connected to the sound feedback generator or vibration feedback generator by cables, but wireless connections are possible, if desired. The sound feedback generator, typically, comprises a loudspeaker to emit sound to the user. Such a loudspeaker may be integrated in the movable part but can also be situated externally, for example to emit sound to a group of users. Alternatively, the sound is transmitted as electronic signals to headphones to be worn by the user. The latter solution implies that children may play without disturbing other people. Also, users, such as children, may play individually on the playground without disturbing each other. For example, an older child may listen to one story on a playground, or even device, whereas another child listens to a different story or other kind of sound pattern on the same playground.

In an advanced embodiment of the invention, children may compete against each other on the playground by using the different devices, each child listening to their relevant part of a game story through headphones, where the told game story binds the activities of the different children together in a game telling parts of the game story in dependence of the activities of the other children. Therefore, the invention also comprises a playground with a number of devices according to the invention.

On a general basis, the invention comprises a playground, wherein each playground device has a ground supported, movable part and at least one motion sensor configured for sensing the motion of the movable part, each of the motion sensors being functionally connected to a common sound signal feedback generator that is configured for converting the signals from the motion sensors of the different devices into a common sound feedback in response to the motion of the different movable parts.

As it occurs from the above, the possibilities for entertainment and the promotion of activity are numerous for a device according to the invention.

The sound pattern to be generated, the music to be played, the story to be told, or the game to be played can be programmed into the sound or vibration feedback generator, which in a wide sense is a computer with special capabilities. The programs can be stationary inside the feedback generator, however, it is preferred that the feedback generator is configured for programming and comprises a data read means, for example, a reading unit for reading from a connected memory stick. Alternatively, the necessary program data may be transmitted wireless to the feedback generator.

The feedback generator may have an accessible start and stop switch. Alternatively, the start and stop may be achieved by wireless transmission of commands. In a specific embodiment, the feedback generator may be activated by insertion of a data medium with digital program data into the feedback generator, or by other kind of transmission, cabled or wireless, of program data to the feedback generator. In addition or alternatively, the starting procedure may occur as soon as a person activates the movable part or as soon as a person approaches the playground device with a mobile device if exchange of data between the playground device and the mobile device occurs. The latter may advantageously be combined with a weight sensor such that the motion induced by wind is not sufficient. The data memory may comprise data for several different sound and vibration performances and may be chosen as options by the user.

The feedback of the sound generator or the vibration generator or both may be stopped again, simply by removing the data medium. Alternatively, the feedback generator may use one or several of the above mentioned variety of sensors to automatically stop the feedback in situations where the user leaves the device.

The sound feedback generator may comprise

- a data read unit for reading digital data from a data storage medium,
- a computer programmed to receive program data from the data storage medium via the data read unit, for example from the data storage device of a mobile device, such as a telephone, and programmed to receive measurement data from the sensor or sensors, the data from the sensor or sensors being indicative of the motion of the movable object, for example the position, orientation, speed, and/or acceleration, a sound amplifier functionally connected, for example by a wireless connection, to the computer for amplifying sound generated by the computer on the basis of the program data and the sensor signals, a loudspeaker electronically connected to the amplifier to emit sound generated by the amplifier.

A device according to the invention may be provided by installing an add-on unit comprising the motion sensor and the sound feedback signal generator to existing playground devices. Such an add-on unit may in a compact and robust version as described above also comprise an amplifier and a loudspeaker, unless these parts are desired as separate units. In the latter case, communication between the units may be achieved with wireless connections, for example Bluetooth connections. Bluetooth is known as data transmission means for data transmission between mobile telephones and headphones.

SHORT DESCRIPTION OF THE DRAWINGS

Figure 1B:
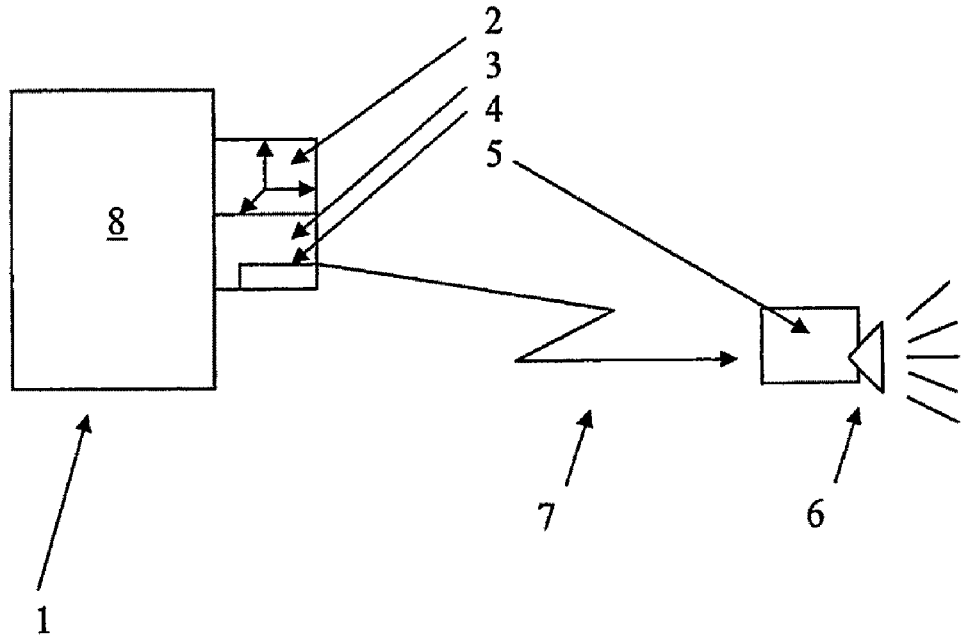
Figure 2A:
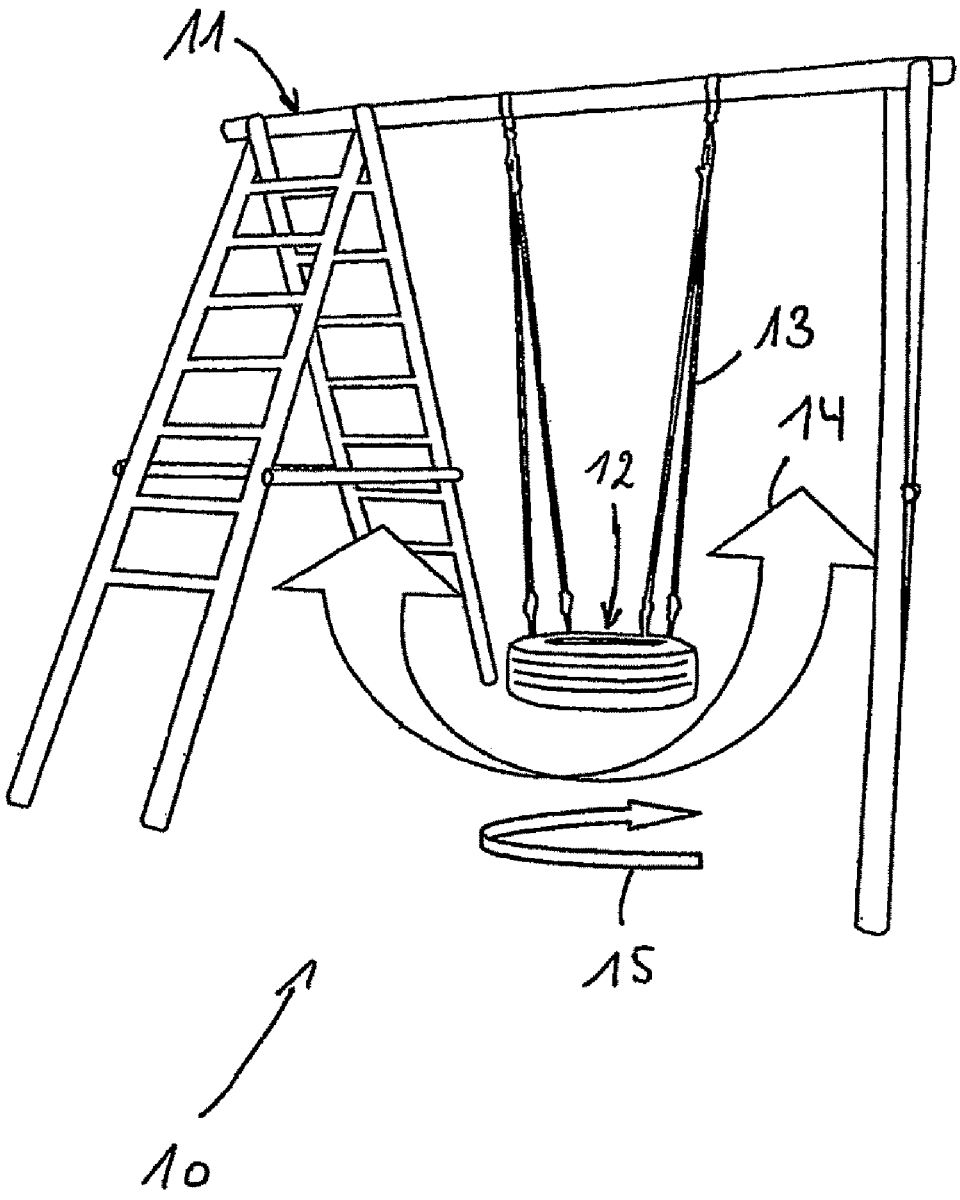
Figure 2B:
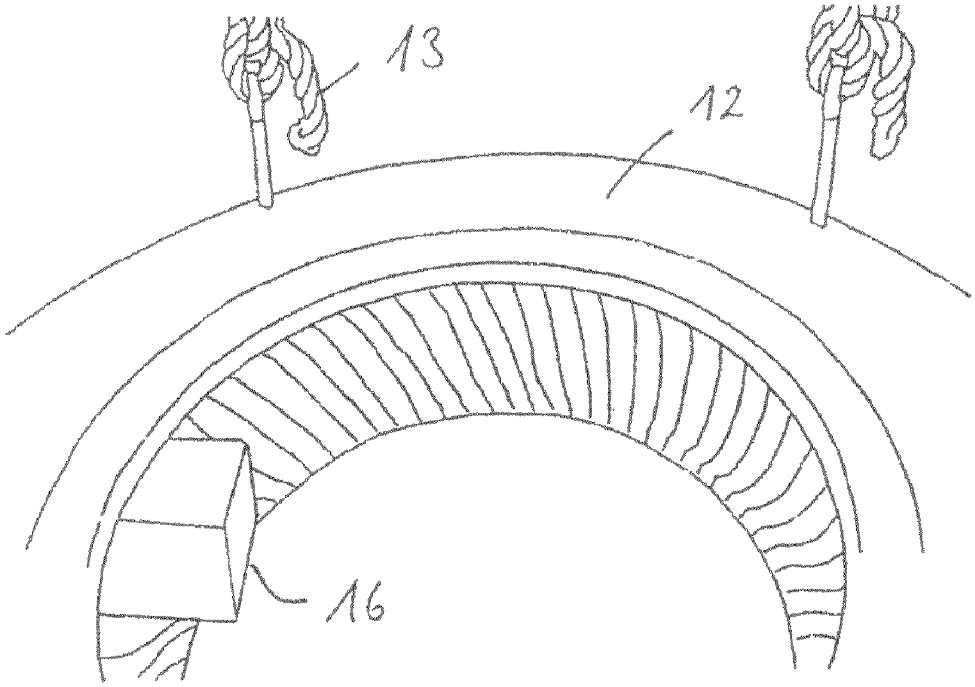
Figure 2C:
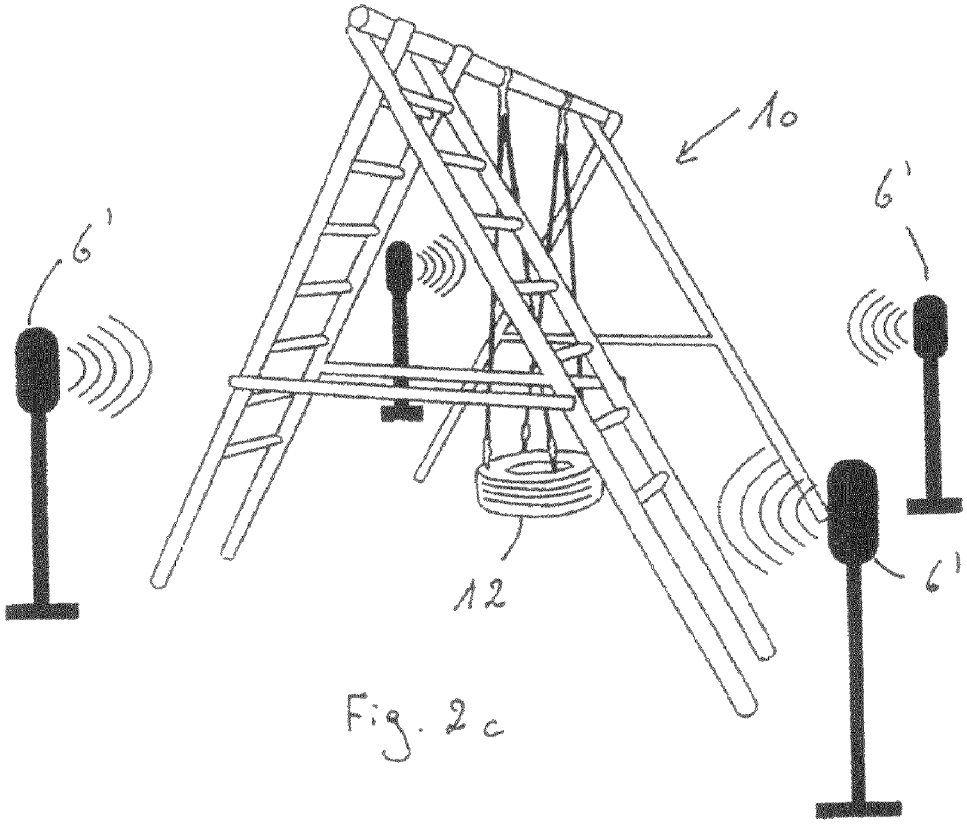
Figure 2D:
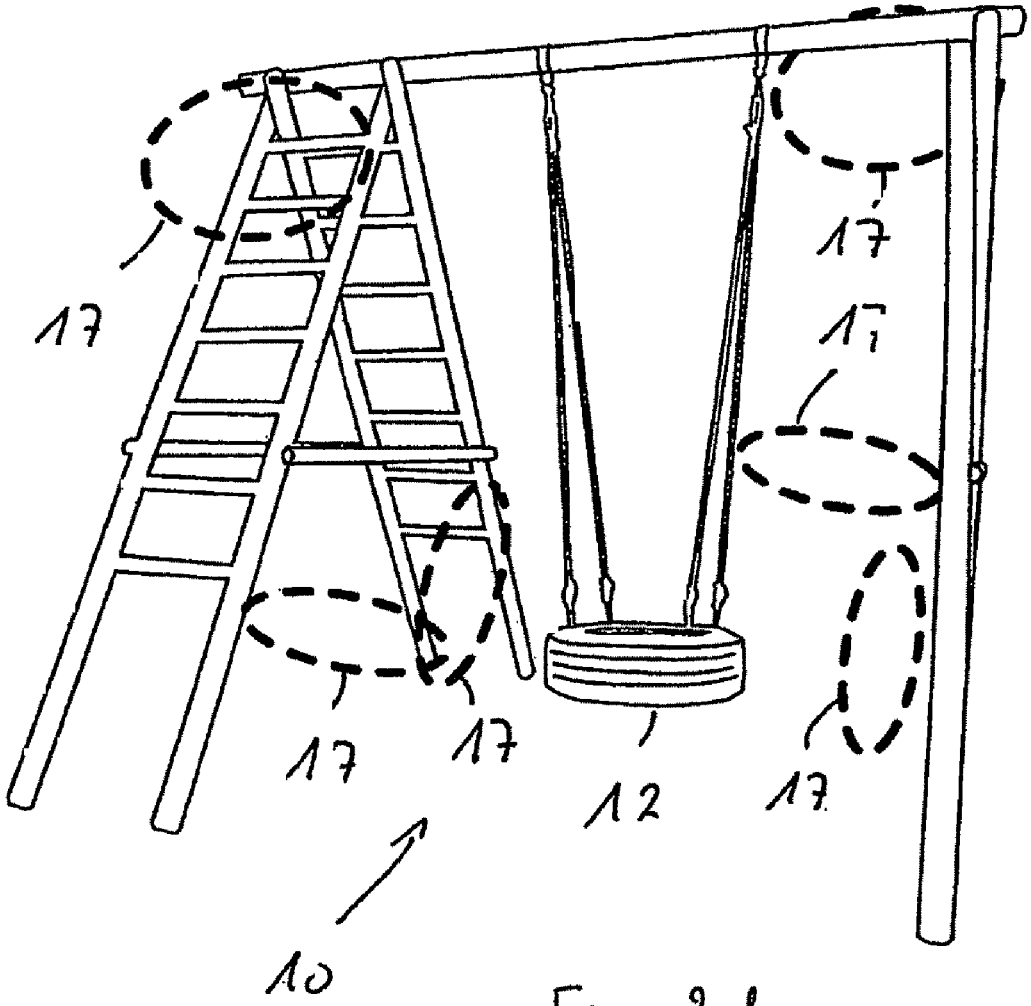
Figure 3:
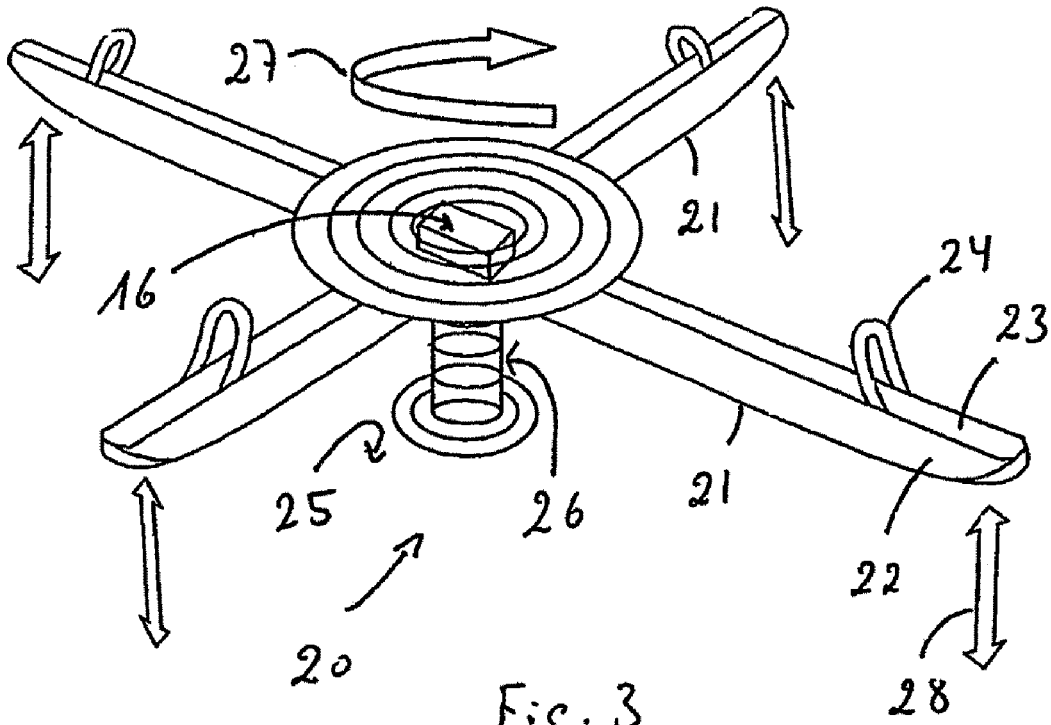
Figure 4:
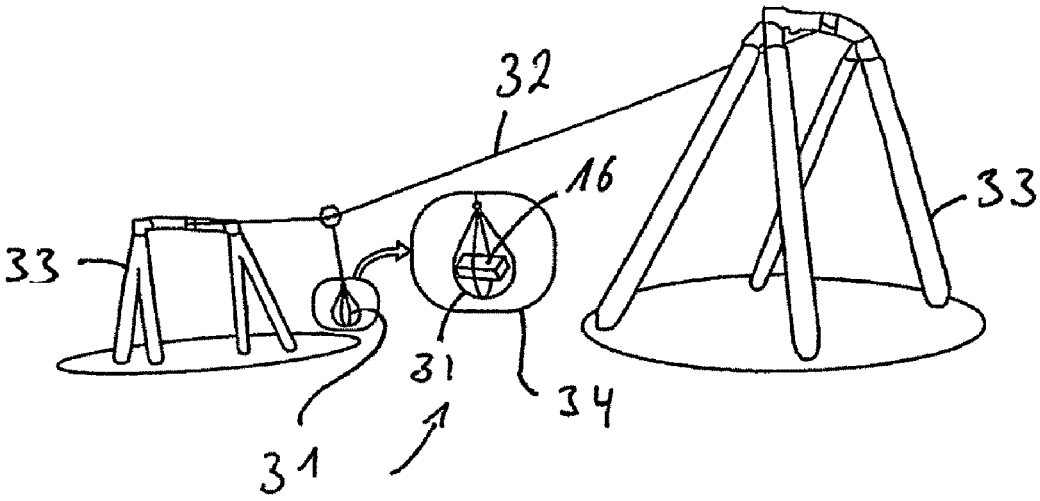
Figure 5:
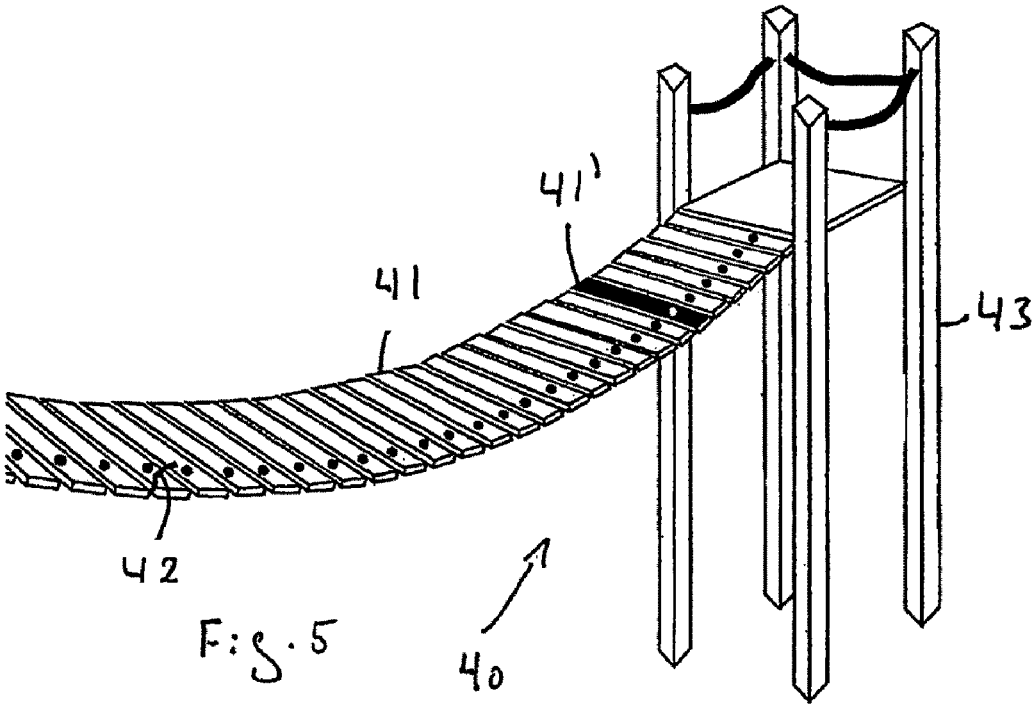
Figure 6:
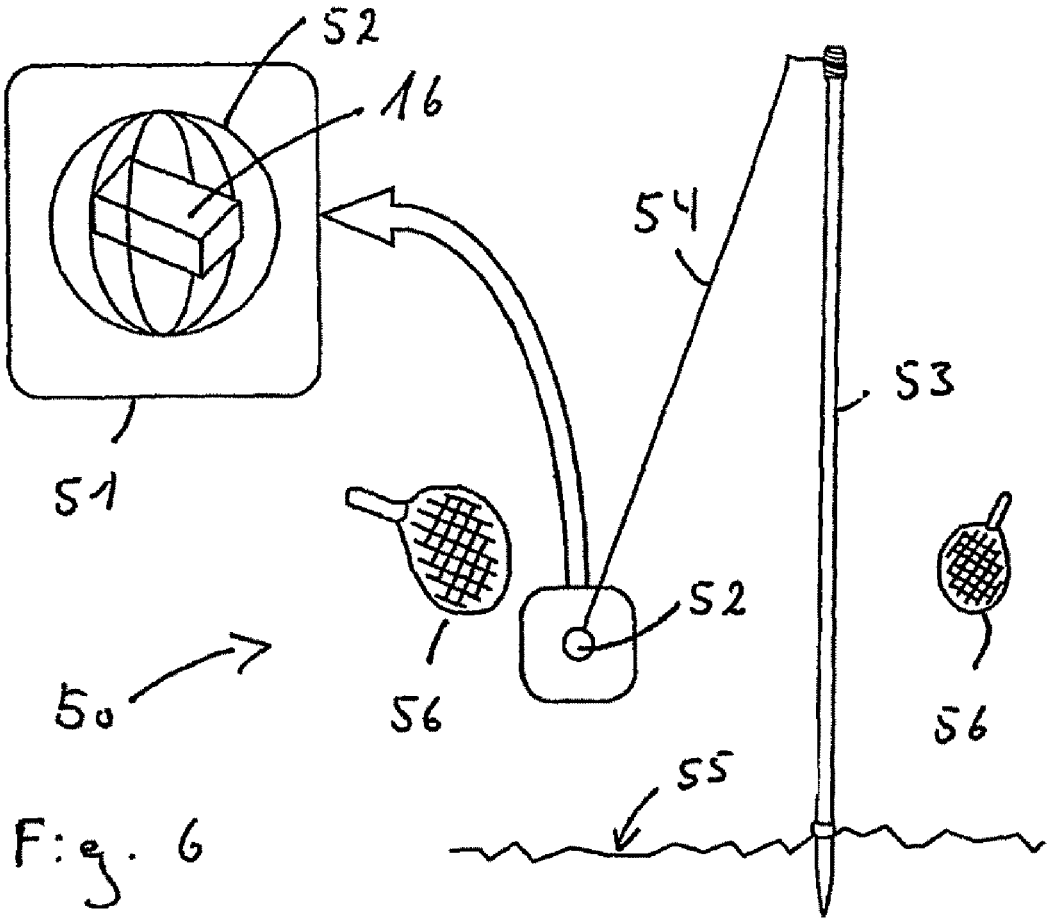
Figure 7:
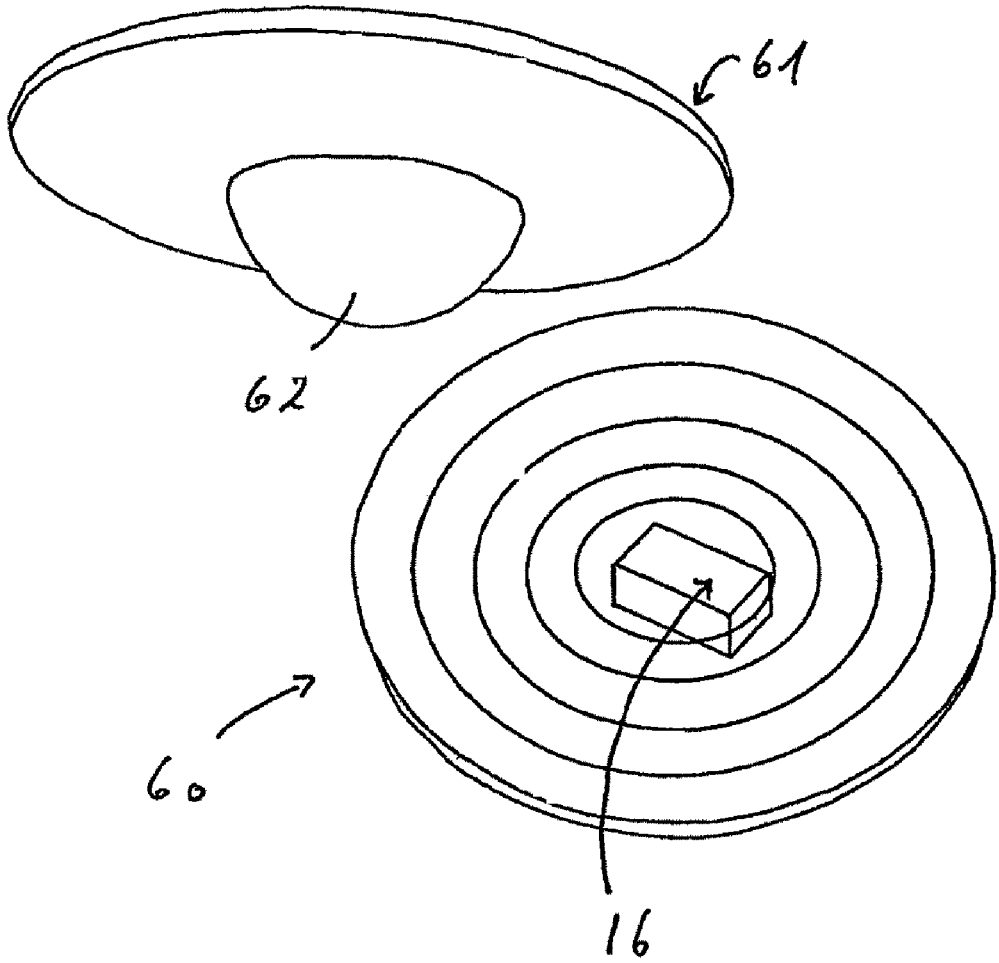

The invention will be explained in more detail with reference to the drawing, where FIG. 1 illustrates the principle of the invention, FIG. 2 illustrates a swing according to the invention, FIG. 3 illustrates a see saw according to the invention, FIG. 4 illustrates a ropeway according to the invention, FIG. 5 illustrates a suspension bridge according to the invention, FIG. 6 illustrates a pole tennis according to the invention, FIG. 7 illustrates a balance board according to the invention.

DETAILED DESCRIPTION/PREFERRED EMBODIMENT

FIG. 1 illustrates the principle of the invention. A playground device 1 comprises a ground supported, movable part 8 and at least one motion sensor 2 configured for sensing the motion of the movable part, for example in three dimensions as indicated by the three dimensional coordinate system in the schematic sensor 2. The motion sensor 2 is functionally connected to a sound signal feedback generator 3 that is configured for converting the signals from the motion sensor into a sound feedback in response to the motion of the movable part. The sound signal feedback generator further comprises an interface 4 for a data storage device, for example a mobile telephone, a memory stick or a memory card.

The sound signal feedback generator is functionally connected to an amplifier 5 in order to emit sound through a loudspeaker system 6. The functional connection may be by cables or wireless as indicated by an arrow 7 in FIG. 1*b*, where the motion sensor 2 and the sound signal feedback generator 3 are comprised in one unit and the amplifier is in a separate unit.

The unit according to the invention is preferably an add-on unit that can be mounted on the ground supported movable part, for example in the form of a box as indicated in the following figures.

FIG. 2*a* illustrates a typical swing 10, with an on the ground standing, stationary frame 11 and a movable part in the form of a standing support 12 designed as a ring/tyre fastened to the stationary frame 11 by wires 13. The tyre 12 may swing back and forth as illustrated by arrow 14 and may rotate as indicated by arrow 15. As illustrated in more detail in FIG. 2*b*, an add-on unit 16 is located inside the hollow tyre 12. With reference to FIG. 1, the add-on unit 16 of FIG. 2*b* comprises the motion sensor 2 and the sound feedback signal generator 3 and, optionally, also the amplifier 5 and loudspeaker 6.

Alternatively, as illustrated in FIG. 2*c*, the amplifier and loudspeakers 6' are located outside the swing 10 and the add-on unit 16 comprises only the motion sensor and the sound feedback signal generator and a transmitter for transmission of the sound feedback signal to the amplifier inside the loudspeaker systems 6'.

The sound feedback signal generator may be programmed to give a first sound feedback, if the seat or standing support is in a first predetermined region with well defined region boundaries and to give a second, different feedback if the seat or standing support is in is different, second, predetermined region with well defined boundaries. This is illustrated in FIG. 2*d*, where examples of such regions 17 are indicated, which the user of the swing has to enter in order to get a certain sound feedback, for example a certain part of a story or a certain score in a game. The game may be provided in a program stored on e.g. a memory card or mobile device. Whether the user enters the regions is measured by the motion sensor.

An alternative device is illustrated in FIG. 3, showing a see saw 20 with a crossed beams 21, where each end 22 of the beams 21 has a seat 23 with a handle 24. The crossed beams are supported on the ground 25 by a support 26 on which the crossed beams 21 are mounted such that the beams' ends 22 may move up and down, as illustrated by arrows 28. The cross of beams 21 may also rotate around the support as illustrated by an arrow 27. The add-on unit according to the invention is illustrated as a box 16 inside the movable beam cross. Alternatively, each seat 22 may be equipped with an add-on unit.

A further alternative device according to the invention is shown in FIG. 4 in the form of a ropeway 30, where a movable seat 31 is slidingly connected to a wire 32 which in turn is fastened to a pair of stationary, ground supported frames 33. The motion sensor 2 and the sound feedback signal generator 3 and, optionally, also the amplifier 5 and loudspeaker 6, are integrated in a box 16 inside the seat, as shown in the enlarged insert 34 in the figure, analogous to the embodiment in the form of a swing as illustrated in FIG. 2.

A further alternative device according to the invention is shown in FIG. 5 in the form of a suspension bridge 40, where planks 41 are held together by a rope system 42 supported by a frame 43. The motion sensor 2 and the sound feedback signal generator 3 and, optionally, also the amplifier 5 and loudspeaker 6, are integrated in a plank 41' or in a box attached to a plank 41'.

FIG. 6 illustrates pole tennis 50, where the motion sensor 2 and the sound feedback signal generator 3 and, optionally, also the amplifier 5 and loudspeaker 6 are integrated in a box 16, as illustrated in the enlarged insert 51, inside the ball 52. The pole tennis comprises a pole 53 supported stationary on the ground 55, and the ball 52 fastened to the pole 53 by means of a wire 54. With bats 56, the ball has to be hit by the players.

FIG. 7 illustrates a balance board 60 with a flat upper part 61 and a semispherical lower part 62 which is designed for being placed on the ground. The motion sensor 2 and the sound feedback signal generator 3 and, optionally, also the amplifier 5 and loudspeaker 6, are integrated in a box 16 inside the balance board 60.

The invention claimed is:

1. Playground device having a ground supported, movable part and at least one motion sensor configured for sensing the motion of the movable part, the motion sensor being functionally connected to a sound signal feedback generator that is configured for converting the signals from the motion sensor into a sound feedback in response to the motion of the movable part, wherein at least one sensor is mechanically connected only to the movable part, wherein the sound signal feedback generator and the motion sensor are located in a single unit.

2. Playground device according to claim 1, wherein the single unit is an add-on unit for installation on or in existing playground devices.

3. Playground device according to claim 2, wherein the add-on unit comprises a sound amplifier and a loudspeaker.

4. Playground device according to claim 2, wherein the add-on unit is a seat or standing support for a person in which the sound feedbaack signal generator and the motion sensor and, optionally, the sound amplifier and a loudspeaker are integrated.

5. Playground device according to claim 1, wherein the device is a swing and the movable part is a seat or stand support.

6. Playground device according to claim 1, wherein the device is a see saw and the moving part is a see saw beam cross with a seat on four sides of a rotational support of the beam cross.

7. Playground device according to claim 1, wherein the device is a ropeway with a seat or standing support held movably by a rope or wire fastened between ground supports.

8. Playground device having a ground supported, movable part and at least one motion sensor configured for sensing the motion of the movable part, the motion sensor being functionally connected to a sound signal feedback generator that is configured for converting the signals from the motion sensor into a sound feedback in response to the motion of the movable part, wherein at least one sensor is mechanically connected only to the movable part, wherein the sound feedback signal generator comprises an interface for a data storage medium.

9. Playground device according to claim 8, wherein the data storage medium is a memory card or memory stick.

10. Playground device according to claim 8, wherein the interface is configured for connection with a memory stick, memory card, mobile telephone, MP3 player, or PDA.

11. Playground device according to claim 8, wherein the device is a swing and the movable part is a seat or stand support.

12. Playground device according to claim 8, wherein the device is a see saw and the moving part is a see saw beam cross with a seat on four sides of a rotational support of the beam cross.

13. Playground device according to claim 8, wherein the device is a ropeway with a seat or standing support held movably by a rope or wire fastened between ground supports.

14. Playground device having a ground supported, movable part and at least one motion sensor configured for sensing the motion of the movable part, the motion sensor being functionally connected to a sound signal feedback generator that is configured for converting the signals from the motion sensor into a sound feedback in response to the motion of the movable part wherein at least one sensor is mechanically connected only to the movable part, wherein the device has a stationary, ground supported frame and the movable part connected to the frame.

15. Playground device according to claim 14, wherein at least one sensor is electronically connected to a data sending unit configured for wireless transmission of data to the sound signal feedback generator, wherein the sound signal feedback generator comprises a data receiver for wireless receiving of the transmitted data.

16. Playground device according to claim 14, wherein the movable part comprises a seat or stand support configured for supporting a person, and wherein the seat or stand support has integrated therein at least one motion sensor.

17. Playground device having a ground supported, movable part and at least one motion sensor configured for sensing the motion of the movable part, the motion sensor being functionally connected to a sound signal feedback generator that is configured for converting the signals from the motion sensor into a sound feedback response to the motion of the movable part, wherein at least one sensor is mechanically connected only to the movable part, wherein the at least one motion sensor is configured to measure independently in three dimensions, and wherein the sound signal feedback generator is configured to give a sound signal feedback varying dependent on, whether the movement is in a first dimension, in a second dimension, in a third dimension or in a combination of the first, the second dimension and the third dimension.

18. Playground device according to claim 17, wherein the motion sensor is configured to measure acceleration of the movable part.

19. Playground device having a ground supported, movable part and at least one motion sensor configured for sensing the motion of the movable part, the motion sensor being functionally connected to a sound signal feedback generator that is configured for converting the signals from the motion sensor into a sound feedback in response to the motion of the movable part, wherein at least one sensor is mechanically connected only to the movable part, wherein the device also comprises a sound sensor for measuring the background sound level around the movable part, the sound sensor being electronically connected to the sound feedback generator is, and wherein the sound feedback generator is configured for adjusting the feedback sound level in dependence of the background sound level.

20. Playground device having a ground supported, movable part and at least one motion sensor configured for sensing the motion of the movable part, the motion sensor being functionally connected to a sound signal feedback generator that is configured for converting the signals from the motion sensor into a sound feedback in response to the motion of the movable part, wherein at least one sensor is mechanically connected only to the movable part, wherein the device is a swing and the movable part is a seat or stand support, wherein the playground device is configured to give a sound feedback depending on the position of the seat or stand support during swinging, wherein the sound feedback signal generator is programmed to give a first feedback if the seat or standing support is in a first predetermined region with web defined region boundaries and to give a second, different feedback if the seat or standing support is in is different, second, predetermined region with well defined boundaries.

* * * * *

UNITED STATES PATENT AND TRADEMARK OFFICE

CERTIFICATE OF CORRECTION

PATENT NO. : 8,047,925 B2
APPLICATION NO. : 11/990476
DATED : November 1, 2011
INVENTOR(S) : Burgaard et al.

It is certified that error appears in the above-identified patent and that said Letters Patent is hereby corrected as shown below:

In the claims:

Column 11, line 16, change “feedbaack” to “feedback”.

Signed and Sealed this
Twenty-seventh Day of December, 2011

David J. Kappos

David J. Kappos
*Director of the United States Patent and Trademark Office*